US007456813B2

(12) United States Patent
Leo et al.

(10) Patent No.: US 7,456,813 B2
(45) Date of Patent: Nov. 25, 2008

(54) LIQUID CRYSTAL DISPLAY OF IMPROVING DISPLAY COLOR CONTRAST EFFECT AND RELATED METHOD

(75) Inventors: Hon-Yuan Leo, Tainan County (TW); Mao-Jung Chung, Tainan County (TW); Yung-Yuan Ho, Tainan County (TW); Yen-Chen Chen, Tainan County (TW)

(73) Assignee: Himax Technologies Limited, Fonghua Village, Sinshih Township, Tainan County (TW)

( * ) Notice: Subject to any disclaimer, the term of this patent is extended or adjusted under 35 U.S.C. 154(b) by 663 days.

(21) Appl. No.: 10/906,327

(22) Filed: Feb. 15, 2005

(65) Prior Publication Data

US 2006/0050035 A1 Mar. 9, 2006

(30) Foreign Application Priority Data

Sep. 6, 2004 (TW) ..... 93126922 A

(51) Int. Cl.
*G09G 3/36* (2006.01)

(52) U.S. Cl. ..... 345/92; 345/94

(58) Field of Classification Search ..... 345/92, 345/94, 96

See application file for complete search history.

(56) References Cited

U.S. PATENT DOCUMENTS

| | | | | |
|---|---|---|---|---|
| 6,456,268 | B1 | 9/2002 | Takeda | |
| 6,750,834 | B2 | 6/2004 | Shen | |
| 2002/0186192 | A1 * | 12/2002 | Maruoka et al. | 345/87 |
| 2003/0214470 | A1 * | 11/2003 | Sun | 345/87 |
| 2004/0155850 | A1 * | 8/2004 | Kida et al. | 345/99 |
| 2004/0164943 | A1 | 8/2004 | Ogawa | |
| 2007/0296678 | A1 * | 12/2007 | Fukuda et al. | 345/98 |

FOREIGN PATENT DOCUMENTS

| | | |
|---|---|---|
| TW | 502237 | 9/2002 |
| TW | 521244 | 2/2003 |
| TW | 200407833 | 5/2004 |

* cited by examiner

*Primary Examiner*—Amr Awad
*Assistant Examiner*—Randal Willis
(74) *Attorney, Agent, or Firm*—Winston Hsu

(57) ABSTRACT

A liquid crystal display (LCD) includes a plurality of pixels, a source driver and a gate driver, each pixel comprising a transistor, a storage capacitor, a pixel electrode, a common electrode coupled to a common voltage, and liquid crystal molecules located between the pixel electrode and the common electrode, the transistor conducting a grey-scale signal generated by the gate driver to the pixel electrode based on a scan voltage generated by the gate driver, the LCD being characterized in that a substrate electrode of the transistor is coupled to a first voltage, and the storage capacitor is coupled to a substrate voltage and the transistor. The common voltage is positive proportional to the substrate voltage.

18 Claims, 5 Drawing Sheets

LIQUID CRYSTAL DISPLAY OF IMPROVING DISPLAY COLOR CONTRAST EFFECT AND RELATED METHOD

BACKGROUND OF INVENTION

1. Field of the Invention

The present invention relates to a Liquid Crystal Display (LCD) display and related method, and more particularly, to an LCD display capable of improving color contrast phenomenon while displaying an image and a related method for improving such phenomenon.

2. Description of the Prior Art

Liquid Crystal Display (LCD) panels having a plurality of transistors and capacitors in an array can display vivid images and are widely used all over the world. The LCD panels, due to their light weight, low power consumption, and no radiation, have increasingly replaced traditional Cathode Ray Tube (CRT) monitors and are also used in portable electrical devices such as notebook computers and Personal Digital Assistants (PDAs).

An LCD display includes a liquid crystal layer comprising liquid crystal molecules sandwiched between two indium tin oxide sheets of glass (ITO glass). One of the glass layers serves as a pixel electrode and the other serves as a common electrode. The alignment of the sandwiched liquid crystal molecules changes as the voltage across the two electrodes changes. Therefore, various gray levels are provided based on different alignments of the liquid crystal molecules.

In general, as a person skilled in this art is aware, the voltage across the two electrodes has two polarities. A voltage of the pixel electrode larger than a voltage of the common electrode is called positive polarity, and a voltage of the common electrode larger than that of the pixel electrode is called negative polarity. If absolute values of the voltage difference across the two electrodes are identical, no matter whether the voltage value of the pixel electrode or that of the common electrode is higher, an identical gray level is obtained. However, an opposed voltage difference value across the two electrodes results in the opposed alignment of the liquid crystal molecules.

From a view of long-term sum effect, if the voltage across the two electrodes tends toward either polarity for a long time, the alignment of the liquid crystal molecules will fail to be varied based on the required control voltage, resulting in the display of incorrect gray levels. In an extreme situation, it is possible that if the voltage across the two electrodes tends toward either polarity for a long enough time, even if no voltage is applied, the liquid crystal molecules will still fail to be aligned because of varying electrical fields due to malfunctioning of the liquid crystal molecules. As a result, in order to prevent the liquid crystal molecules invalidity as the voltage applied across the two electrodes tends toward either polarity, the voltages across the two electrodes are periodically switched between positive polarity and negative polarity.

Please refer to FIG. 1, which illustrates a diagram of voltage applied on the liquid crystal molecules for a pixel unit in response to the display data combined with the polarity in sequence. In general, a voltage Vcom applied on the common electrode voltage is at a constant 8V, and the display data is combined with alternate positive and negative polarities. As shown in FIG. 1, an absolute value of a voltage difference between the gray-level voltage (12V) corresponding to the gray-level of the display data (+FF) and the common voltage Vcom is 4V. Similarly, an absolute value of a voltage difference between the gray-level voltage (4V) corresponding to the gray-level of the display data (−FF) and the common voltage value Vcom is 4V. Therefore, identical absolute values of voltage differences but exactly opposed polarities cause opposed alignments of the liquid crystal molecules and indicate the same gray-level.

Please refer to FIG. 5, which illustrates a relationship of a reflectance versus voltage difference corresponding to RGB curves. As can be seen in FIG. 5, smooth RGB curves in an interval of 0-1V are illustrated. In other words, in the interval of 0-1V, each of the RGB curves correspond to high reflectance values but low reflectance variety. This indicates that, in the interval of 0-1V, higher luminance as well as low color contrast is obtained. Because people's eyes are more sensitive to bright color than to dark color, it is hard for people's eyes to distinguish color contrast corresponding to the grey-scale data defined in the range of 0-1V. Consequently, a conventional LCD requires improvement.

SUMMARY OF INVENTION

According to the claimed invention, a Liquid Crystal Display (LCD) comprises: a source driver and a gate driver; a plurality of pixels, each pixel comprising a transistor, a storage capacitor, a pixel electrode, a common electrode coupled to a common voltage, and liquid crystal molecules located between the pixel electrode and the common electrode. The transistor is for conducting a gray-scale signal generated by the source driver to the pixel electrode based on a scan voltage generated by the gate driver; the LCD being characterized in that a substrate electrode of the transistor is coupled to a first voltage, and the storage capacitor is coupled to a substrate voltage and the transistor. The common voltage is positive correlation with respect to the substrate voltage.

According to the claimed invention, a method of controlling display of an LCD comprises the following steps:

(a) adjusting a common voltage value of a common electrode based on a polarity signal;

(b) adjusting a substrate voltage coupled to a storage capacitor based on the polarity signal, wherein the common voltage is positive correlation with respect to the substrate voltage; and (c) displaying an image based on a gray-level signal and the common voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
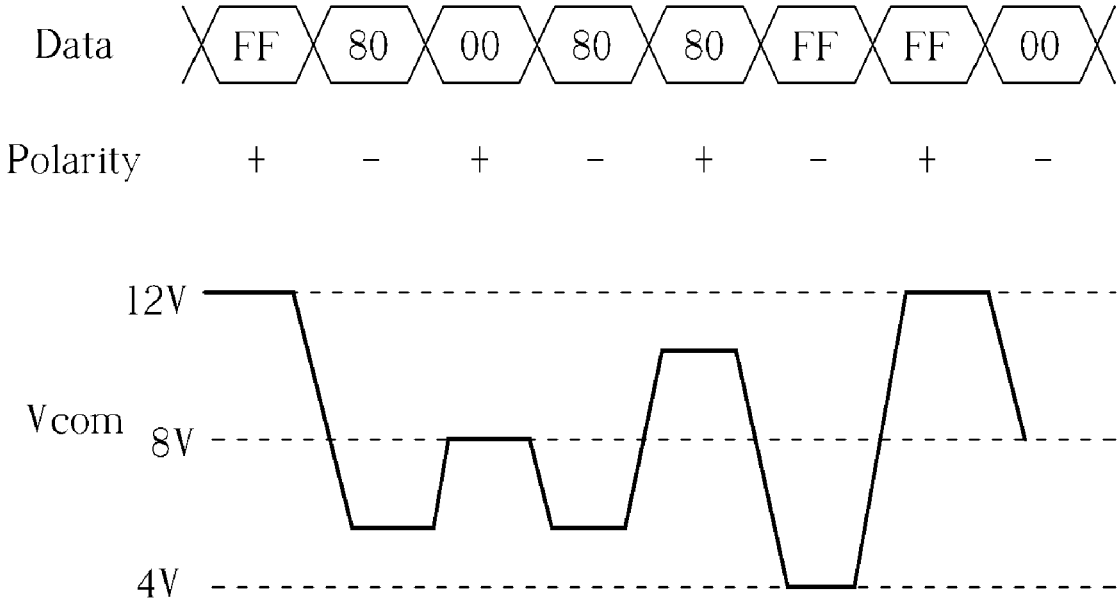
Fig. 1 Prior art
FIG. 1 is a diagram of voltage applied on the liquid crystal molecules for a pixel unit in response to the display data combined with the polarity in sequence.
Figure 2A:
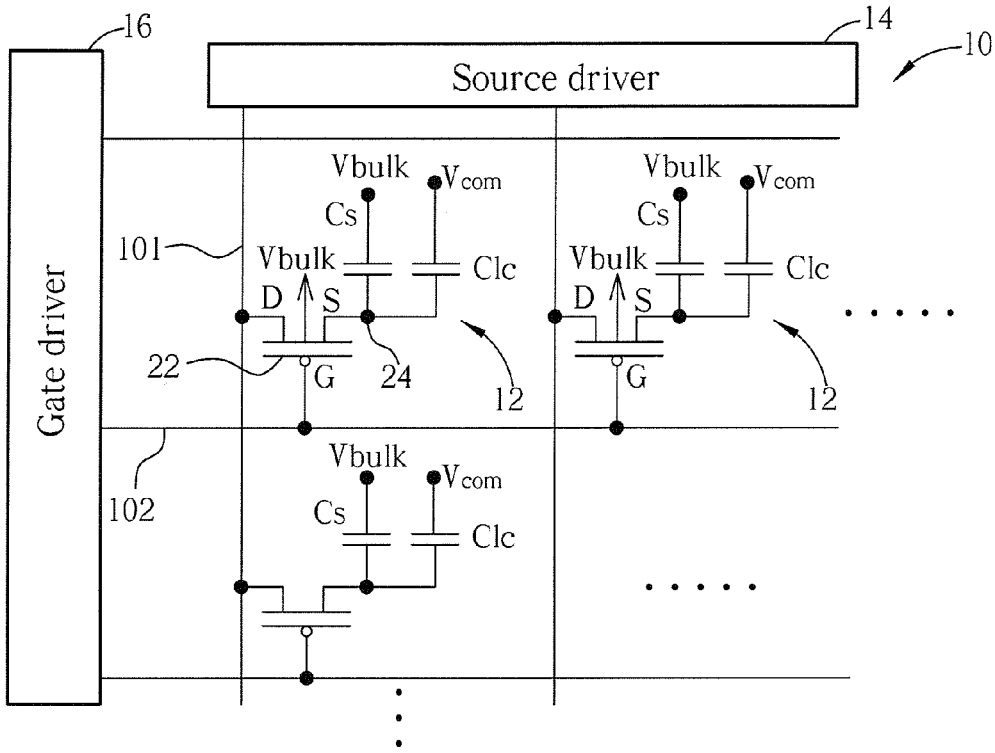
FIG. 2A is a functional block diagram of an embodiment of an LCD according to the present invention.
Figure 2B:
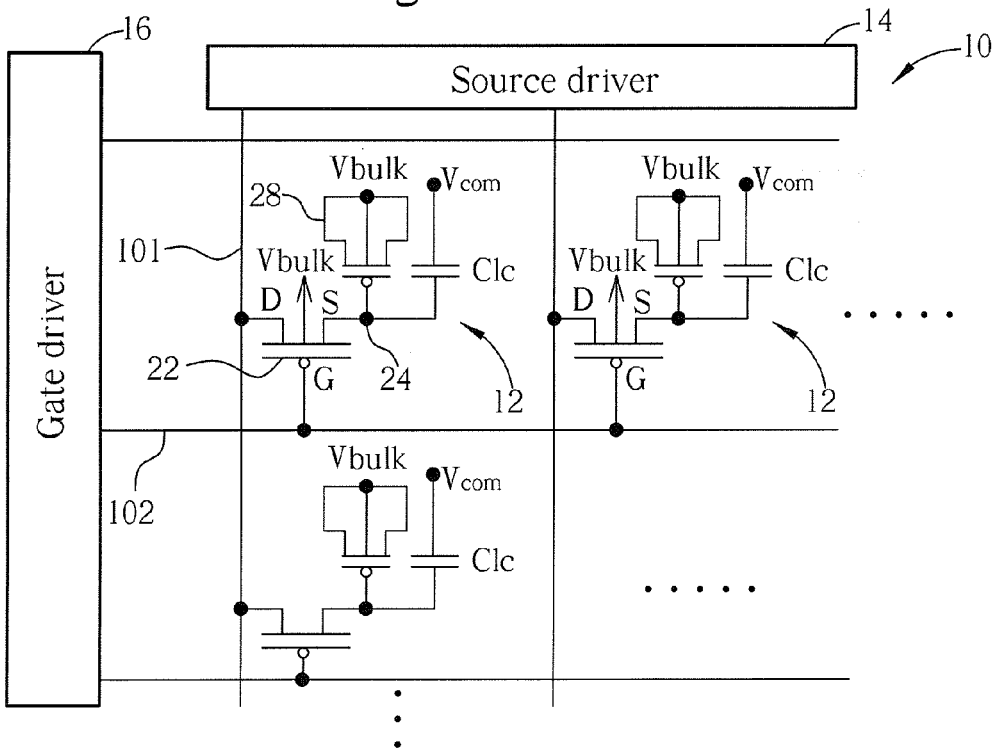
FIG. 2B is a functional block diagram of another embodiment of an LCD according to the present invention.
Figure 3:
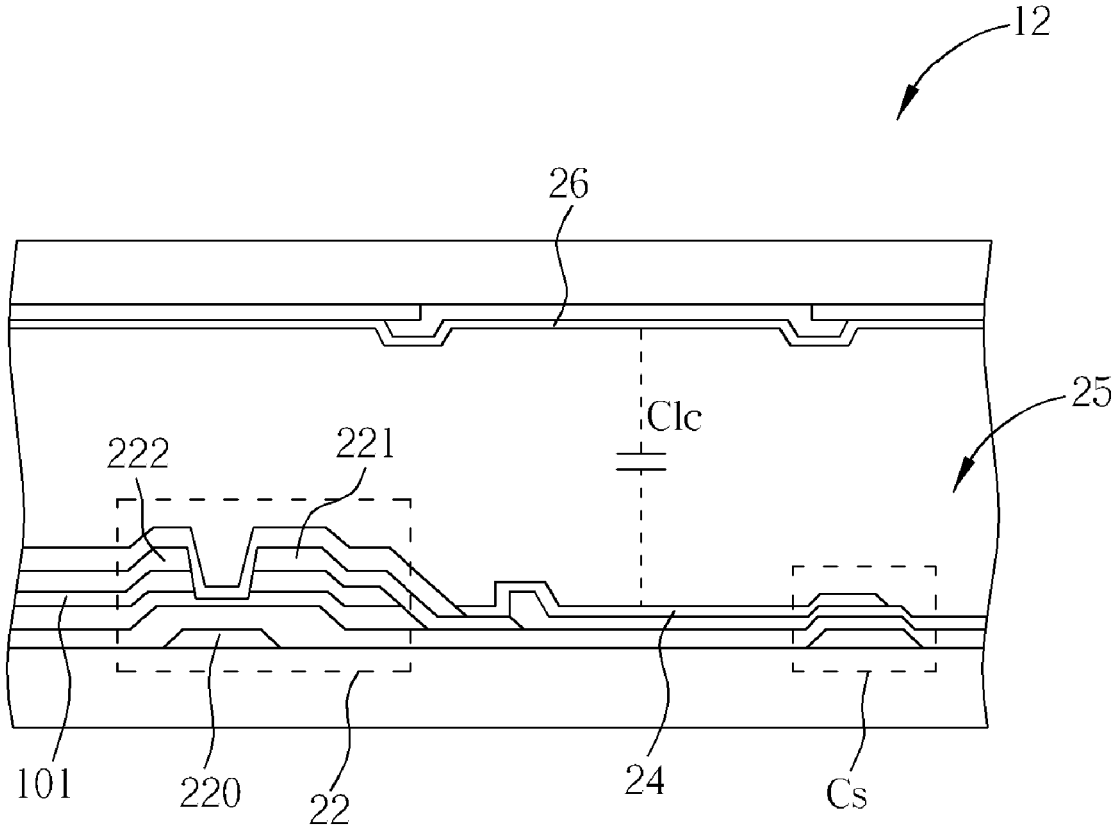
FIG. 3 is a structure diagram of a pixel unit 12 in FIG. 2

Please refer to FIG. 2A, FIG. 2B and FIG. 3. FIG. 2A is a functional block diagram of an embodiment of an LCD 10 according to the present invention. FIG. 2B is a functional block diagram of another embodiment of an LCD 10 according to the present invention. FIG. 3 is a structure diagram of a pixel unit 12 in FIG. 2A. The LCD 10, which can be a Liquid Crystal on Silicon (LCOS), comprises a plurality of pixel units 12, a source driver 14 and a gate driver 16. Each pixel unit 12 comprises a transistor 22 of which a gate 220 is electrically connected to a scan line 102, a drain 221 which is electrically connected to a data line 101, and a source 222 which is electrically connected to a pixel electrode 24. In FIG. 3, each pixel unit 12 also comprises a liquid crystal layer 25, a common electrode 26, and a storage capacitor Cs as the structure shown in FIG. 2A. The storage capacitor Cs can be formed by a transistor 28 whose drain, source and substrate connect together as the structure shown in FIG. 2B. Generally, the substrate electrodes of the transistor 22 and the transistor 28 are coupled to the highest voltage in pixel unit 12. The liquid crystal layer 25 has revolvable liquid crystal molecules. The pixel electrode 24 and the common electrode 26 are formed by indium tin oxide (ITO). A capacitor Clc is formed between the pixel electrode 24 and the common electrode 26.

The gate driver 16 sends a turn-on voltage through the scan line 102 to the transistor 22. As the transistor 22 turns on, the source driver 14 transmits the required gray-scale signals for each image pixel unit 12 to the pixel electrode 24 through the data line 101, so that the storage capacitor Cs will charge to a required voltage value. After the image pixel unit 12 at the last line is finished charging, the gate driver 16 will cycle back to recharge from the first line. As far as an LCD with 60 Hz refresh frequency is concerned, the display time for each frame is about 1/60=1 6.67 ms. In other words, the gate driver 16 will recharge each line approximately every 16.67 ms. The alignment of the liquid crystal molecules in the liquid crystal layer 25 changes is based on a difference ΔV between the gray-scale signal and the common voltage value Vcom. The storage capacitor Cs is used to maintain the voltage difference ΔV as the transistor 22 is turned off, until the corresponding transistor 22 turns on again.

Figure 4:
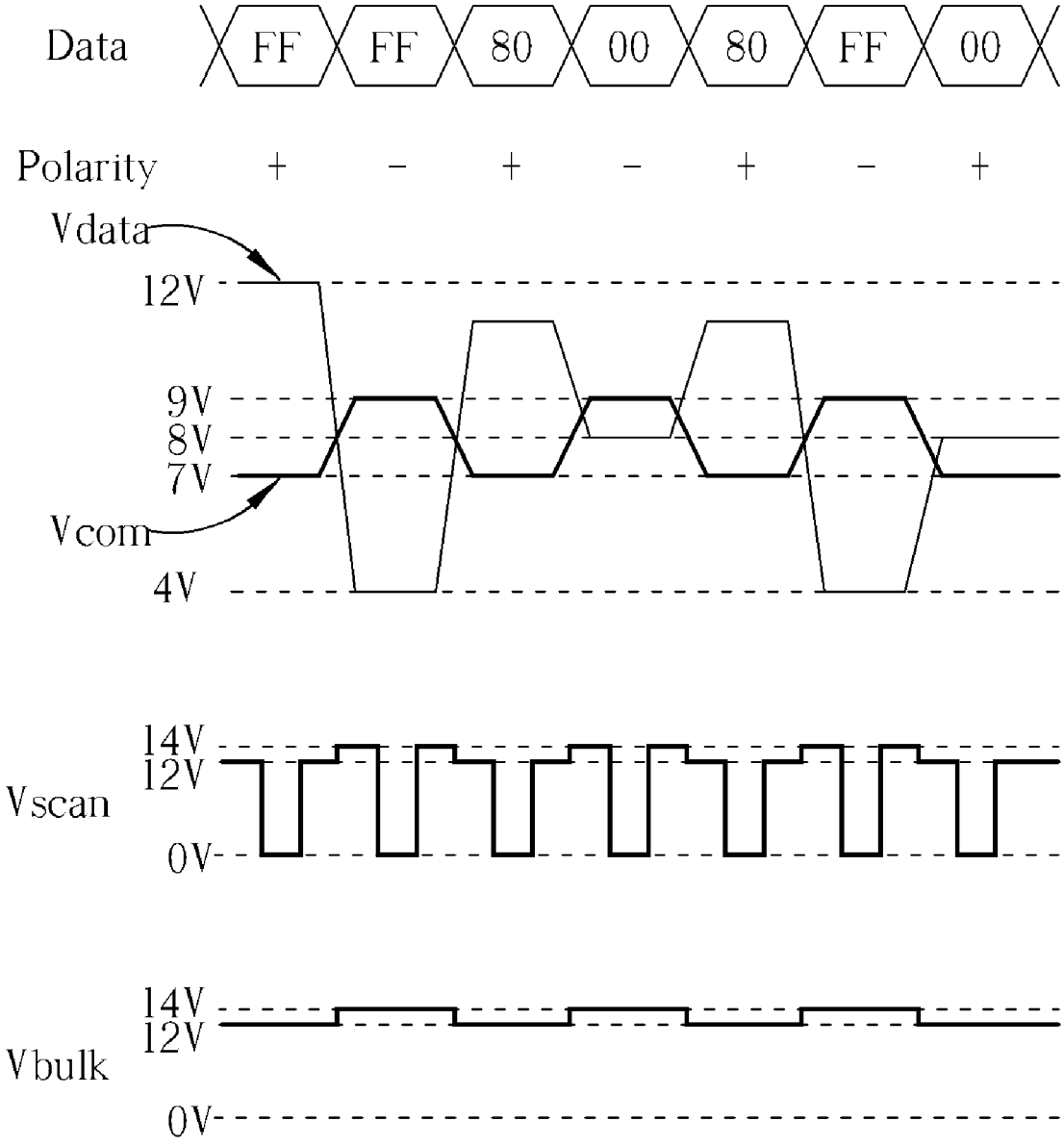
FIG. 4 illustrates a timing diagram of relationship among the gray-level signal Vdata, the common voltage Vcom, the scan voltage Vscan and the substrate voltage Vbulk according to the present invention.
Figure 5:
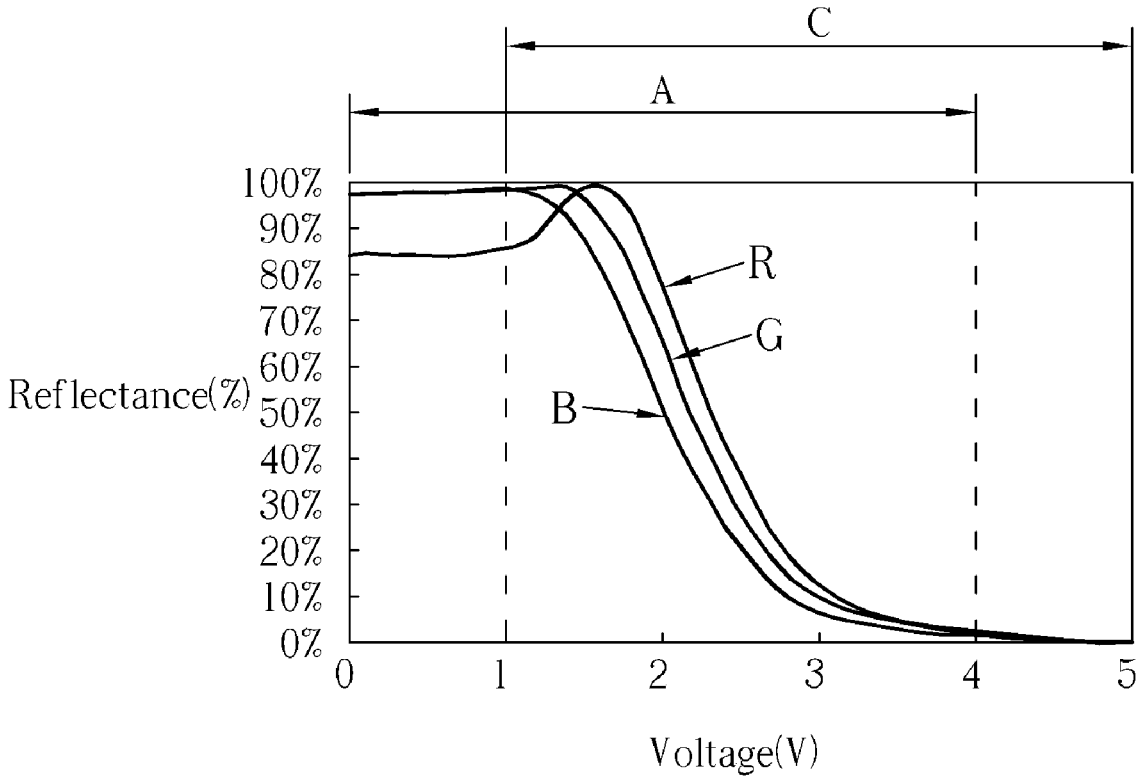
FIG. 5 illustrates a relationship of a reflectance versus voltage difference corresponding to RGB curves

Please refer to FIGS. 2, 4 and 5. FIG. 4 illustrates a timing diagram of a relationship among the gray-level signal Vdata, a common voltage Vcom applied on the common electrode, and a substrate voltage Vbulk applied on the substrate electrode. A grey-level signal Vdata with positive polarity (with an +FF voltage value of 12V) is outputted by the source driver 14 and sent to the pixel electrode 24 via the transmission line 101, as a scan voltage Vscan (which goes from 12V to 0V and then to 12V again) from the gate driver 16 conducts the transistor 22 of a pixel unit 12. Meanwhile, a common voltage Vcom of 7V is applied on the common electrode 26 and a substrate voltage Vbulk of 12V is applied on the substrate electrode. In this operation, a voltage difference ΔV between the common electrode and the pixel electrode is 5V. Afterwards, a grey-scale signal Vdata with negative polarity (with an −FF voltage value of 4V) is outputted by the source driver 14 and sent to the pixel electrode 24 via the transmission line 101, as a scan voltage Vscan (which goes from 14V to 0V and then to 14V again) from the gate driver 16 conducts the transistor 22 of a pixel unit 12. Meanwhile, a common voltage Vcom of 9V is applied on the common electrode 26 and a substrate voltage Vbulk of 14V is applied on the substrate electrode. In this operation, a voltage difference ΔV between the common electrode and the pixel electrode is 5V. Similarly, a grey-scale signal Vdata with positive polarity (with a +00 voltage value of 8V) is outputted by the source driver 14 and sent to the pixel electrode 24 via the transmission line 101, as a scan voltage Vscan from the gate driver 16 conducts the transistor 22 of a pixel unit 12. Meanwhile, a common voltage Vcom of 7V is applied on the common electrode 26 and a substrate voltage Vbulk of 12V is applied on the substrate electrode. In this operation, an absolute value voltage difference ΔV between the common electrode and the pixel electrode is 1V. A grey-scale signal Vdata with negative polarity (with a −00 voltage value of 8V) is outputted by the source driver 14 and sent to the pixel electrode 24 via the transmission line 101, as a scan voltage Vscan from the gate driver 16 conducts the transistor 22 of a pixel unit 12. Meanwhile, a common voltage Vcom of 9V is applied on the common electrode 26 and a substrate voltage Vbulk of 14V is applied on the substrate electrode. In this operation, an absolute value of voltage difference ΔV between the common electrode and the pixel electrode is also 1V. To sum up, an absolute value of the voltage difference between the grey-scale signal Vdata and the common voltage Vcom lies in a range between 1 and 5V. Finally, the alignment of the liquid crystal molecules located between the common electrode and the pixel electrode changes based on the voltage difference ΔV in order to adjust light reflectance.

As can be seen in FIG. 5, the RGB curve in the interval of 0-1V corresponds to greater light reflectance but a low variety of light reflectance. As an example, suppose that a value of the data A (Vdata) is 8.1 V and a value of the data B (Vdata) is 8.8V. In a conventional LCD having a constant common electrode voltage Vcom of 8V, the voltage difference between the data A and the common electrode voltage Vcom is 0.1V, and the voltage difference between the data B and the common electrode voltage Vcom is 0.8V. From FIG. 5, the difference in the two reflectance values respectively corresponding to 0.1V and 0.8V is slight, so people's eyes will hardly notice the slight color contrast between data A and data B. In the exemplary embodiment, the voltage difference between the data A and the common electrode voltage Vcom is 1.1V, and the voltage difference between the data B and the common electrode voltage Vcom is 1.8V. Based on the RGB curves illustrated in FIG. 5, a greater reflectance difference between the data A and data B is obtained, resulting in greater color contrast difference. Because people's eyes are insensitive to dark color, even though RGB curves depict lower reflectance difference in an interval of 4-5V, the data corresponding to the voltage difference of 4-5V displayed on this embodiment LCD appears to be nearly similar to that displayed on the conventional LCD by people's eyes. As a result, in this exemplary embodiment, a voltage difference between the common voltage Vcom applied on the common electrode and the grey-scale data Vdata applied on the pixel electrode is in a range of 1-5V. In this way, referring to FIG. 5, the grey-scale data originally defined in a domain A (0-4V) is shifted to domain C (1-5V).

Please note that when the common voltage Vcom is 7V (i.e. positive polarity), the scan voltage Vscan is 12V, and the substrate voltage Vbulk is 12V, and the transistor 22 turns off. When the common voltage Vcom is 9V (i.e. negative polarity), the scan voltage Vscan and the substrate voltage Vbulk have to increase to 14V to turn off the transistor 22. In other words, while the transistor 22 is switched off, in order to prevent a charge sharing effect, the scan voltage Vscan is positive correlation with respect to the voltage Vbulk applied on the substrate electrode. The gate driver 16 determines the value of the scan voltage Vscan based on the polarity of the grey-scale signal Vdata.

Please refer to FIG. 2 again. In the exemplary embodiment, the substrate electrode of the transistor 22 can be coupled to the substrate voltage Vbulk or the highest voltage terminal with a voltage value (e.g. 14V) higher than or equal to the substrate voltage Vbulk.

In the exemplary embodiment, the transistor 22 and the transistor 28 forming the storage capacitor Cs are PMOS transistors. As a person skilled in the art is aware, the transistors 22 and 28 can also be NMOS transistors, where the substrate electrode is coupled to the lowest voltage end. Please note that the lowest voltage end is less than or equal to the voltage applied on the substrate electrode of the transistor 22.

In contrast to the prior art, a voltage difference between the grey-scale signal and the voltage applied on the common electrode is shifted, so that the color contrast of each pixel unit is greater and display effect of the LCD is better.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display (LCD) device comprising a source driver and a gate driver; a plurality of pixels, each pixel comprising a transistor, a storage capacitor, a pixel electrode, a common electrode coupled to a common voltage, and liquid crystal molecules located between the pixel electrode and the common electrode, the transistor conducting a grey-scale signal generated by the source driver to the pixel electrode based on a scan voltage generated by the gate driver, and the LCD device being characterized in that: a substrate electrode of the transistor is coupled to a first voltage; and the storage capacitor is coupled to a substrate voltage and the transistor; wherein the common voltage is positive correlation with respect to the substrate voltage, and the scan voltage is positive correlation with respect to the substrate voltage during a turn-off period of the transistor.

2. The LCD device of claim 1 wherein the first voltage is the substrate voltage.

3. The LCD device of claim 1 wherein the transistor is a PMOS transistor or an NMOS transistor.

4. The LCD device of claim 1 wherein the first voltage value is equal to or higher than the substrate voltage.

5. The LCD device of claim 1 wherein the first voltage is equal to or lower than the substrate voltage.

6. The LCD device of claim 1 wherein the common voltage in course of positive polarity of the grey-scale signal is less than the common voltage in course of negative polarity of the grey-scale signal.

7. The LCD device of claim 1 wherein the LCD device is a Liquid Crystal on Silicon (LCOS) device.

8. A method of controlling display of a liquid crystal display (LCD) device comprising:

(a) adjusting a common voltage value of a common electrode based on polarity of a grey-scale signal;

(b) adjusting a substrate voltage coupled to a storage capacitor based on polarity of the grey-scale signal, wherein the common voltage is positive correlation with respect to the substrate voltage; and (c) displaying an image based on the gray-level signal and the common voltage.

9. The method of claim 8 further comprising:

writing the gray-level signal into the storage capacitor based on a scan voltage.

10. The method of claim 9, wherein writing the gray-level signal into the storage capacitor is controlled by a transistor as the scan voltage is applied on the transistor.

11. The method of claim 10, wherein the transistor further comprises a substrate electrode coupled to a first voltage.

12. The method of claim 10, wherein the transistor is a PMOS transistor or a NMOS transistor.

13. The method of claim 11, wherein the first voltage is the substrate voltage.

14. The method of claim 11, wherein the first voltage is equal to or higher than the substrate voltage.

15. The method of claim 11, wherein the first voltage is equal to or lower than the substrate voltage.

16. The method of claim 8, wherein the common voltage in course of positive polarity of the grey-scale signal is less than the common voltage in course of negative polarity of the grey-scale signal.

17. The method of claim 8, wherein the LCD device is a Liquid Crystal on Silicon (LCOS) device.

18. A liquid crystal display device being characterized in that:

a substrate electrode of a transistor of a pixel in the liquid crystal display device is coupled to a first voltage;

a common electrode against the substrate electrode is coupled to a common voltage; and a storage capacitor is coupled to a substrate voltage and the transistor;

wherein the common voltage is positive correlation with respect to the substrate voltage.

* * * * *